United States Patent [19]

Bishop

[11] 3,941,154

[45] Mar. 2, 1976

[54] SWIMMING POOL WATER CIRCULATION SYSTEM

[76] Inventor: Kenneth M. Bishop, 310 Market, Carlisle, Iowa 50047

[22] Filed: June 17, 1974

[21] Appl. No.: 479,840

Related U.S. Application Data

[60] Division of Ser. No. 316,259, Dec. 18, 1972, and a continuation-in-part of Ser. No. 1,438, Jan. 8, 1970.

[52] U.S. Cl. . 137/624.15; 137/624.13; 137/625.17; 239/17

[51] Int. Cl.[2] ..... B05B 17/08

[58] Field of Search..... 137/624.4, 624.13, 624.15, 137/625.17; 251/207; 239/16, 17, 18, 19, 20, 97

[56] References Cited

UNITED STATES PATENTS

| | | | |
|---|---|---|---|
| 3,362,641 | 1/1968 | Barnes | 239/97 |
| 3,372,371 | 3/1968 | Lesser | 137/625.17 X |
| 3,399,698 | 9/1968 | Bentley | 137/624.15 |
| 3,549,120 | 12/1970 | Weiss | 251/207 |
| 3,558,100 | 1/1971 | Hulsey | 251/207 |
| 3,570,764 | 3/1971 | Inoue | 239/17 |

*Primary Examiner*—Alan Cohan
*Attorney, Agent, or Firm*—Zarley, McKee, Thomte & Voorhees

[57] ABSTRACT

A swimming pool system including an inlet conduit around the walls of the pool having spaced apart outlet openings directing fountains of water upwardly and inwardly for cooling in the night air and for providing a decorative fountain affect around the periphery of the pool. The inlet conduit is comprised of a plurality of sections each of which is connected to a control flow valve having a continuously rotatable valve element. The valve element is cylindrical and hollow and includes a series of peripheral rows of openings registerable with the inlet conduit sections. Each of the successive openings in the rows are different in shape and size to provide a continuously varying pattern of fountain activity. A reciprocal power means may be provided for reciprocating the cylindrical valve element such that different peripheral rows of openings register alternately with the sections of inlet conduit to further vary the pattern of fountain activity. A vane structure may be provided on the inlet end of the cylindrical valve element to cause the inlet water pressure to continuously rotate the valve element.

1 Claim, 7 Drawing Figures

SWIMMING POOL WATER CIRCULATION SYSTEM

This is a division of application Ser. No. 316,259, filed Dec. 18, 1972, and a continuation-in-part application of application Ser. No. 1438, filed Jan. 8, 1970.

The common conventional residential type pool involves a water system wherein the drain for the pool is provided in the bottom thereof and the connecting pipe to the drain extending to the pump is buried in the ground and in the concrete of the pool if the pool is formed from concrete. Also the inlet water pipes for the pool are buried in the concrete or the ground as are all pipes connecting the pool to the remotely located filter and pump units. It is seldom that the pool walls whether formed of metal or concrete leak but it is not uncommon for leaks to occur in the pipes and conduits. These leaks are almost impossible to locate without digging up all of the conduits and pipes to examine them. Thus it is apparent that the complexity of installation of the ordinary type pool is greatly complicated by the necessity of burying the water inlet and outlet pipes and the maintenance problem is particularly aggravated by having to completely tear up the entire pool to get to the buried pipes for inspection and repair if necessary. The accessbility problem with regard to the filter system and pump unit is similar on most pools and thus represents a considerable problem.

The circulation system for the water in the pool if this invention involves locating all the circulating pipes and conduits in positions readily accessible for inspection and maintenance if required. The inlet conduit extending from a system chamber formed by one of the pool walls is actually in the pool and extends along the pool walls at about the normal water level. A plurality of outlet openings are provided to evenly distribute water throughout the pool. The inlet conduit is spaced a predetermined distance from the pool wall to provide a finger hold or hand rail around the pool. The spacing of the inlet conduit should preferably be insufficient for a person's fingers to extend completely between the pool wall and the back side of the inlet conduit. A series of eye bolt fasteners which receive and hold the inlet conduit extend through the pool wall and are anchored in poured concrete if desired. The lengths of inlet conduit are interconnected by appropriate couplings and are of an appropriate diameter to give the desired water flow at given points around the pool. Additionally, the lengths of inlet conduit may be rotated to direct the jet of water either downwardly into the pool usually for daytime operation or upwardly to provide cooling of the water during the cool nights and to provide a plurality of fountains around the periphery of the pool upon which colored lights may be appropriately directed.

It is seen that when the water jets are directed downwardly wave motions will be caused in the water to agitate the sediment on the bottom of the pool to cause it to rise and be removed by the skimmers. Additionally, it may be desirable to place lengths of hoses at various points around the periphery which will extend to the bottom of the pool and move about on the bottom for agitating the collected sediment. The flow of the water through the inlet pipe may be caused to pulsate and be sequentially operated as desired by the appropriate use of commercially available valves and controls.

The outlet pipe for the pool comprises a pipe located inside the pool and extending directly into the system chamber for communication with the remotely located pump system. If skimmer units are used they would be interconnected by a pipe freely disposed directly below the coping near the pool's edge and this pipe would then extend back to the system chamber. The remotely located pump required by most city ordinances is in communication with the inlet conduit, the outlet pipe and the skimming pipe through pipes located in a passageway directly below the removable coping material. The filtering unit is in the system chamber and thus is directly accessible by removal of the coping material covering it.

Additionally a lighting unit may be located in the system chamber and thus also be directly accessible for inspection and repair when required. It is thus seen that there are no underground or buried pipes or conduits and all of the regulation system can be quickly assembled and inspected after the pool is put in place to find leaks if any should occur. It is never necessary to tear up the ground or pool structure to work on the circulation system. All that is necessary is to remove coping material or the like covering the pool's edge.

The pattern of fountain activity for the various inlet conduit sections can be continuously varied by a variable pattern control flow valve being placed between the water inlet source and the sections of inlet conduit. This control valve can include a cylindrical valve element having peripheral rows of openings of different sizes and shapes registerable with the outlet conduit sections. The size and shape of the openings and the size of the conduit sections in registration therewith are coordinated to give the desired fountain pattern. The inlet side of the valve element may be provided with vanes for causing the inlet water pressure to drive the cylindrical drive element or in the alternative a separate power means may be provided for continuously rotating the valve element. Further, a reciprocal unit may be connected to the valve element for continuously reciprocating the valve element longitudinally to cause the rows of openings to alternately register with the different outlet conduit sections to further vary the fountain activity.

These and other features and advantages of this invention will become readily apparent to those skilled in the art upon reference to the following description when taken into consideration with the accompanying drawings, wherein.

Figure 1:
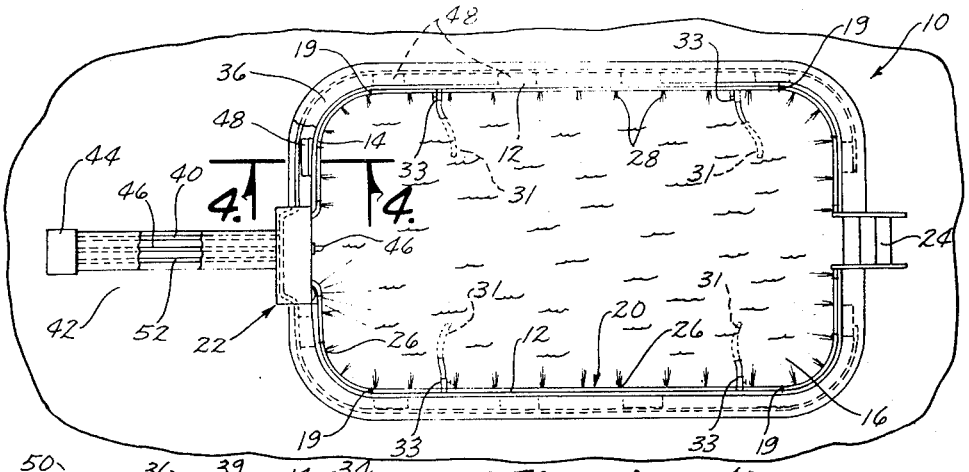
FIG. 1 is a plan view of the pool system of this invention.

The water circulation system of this invention is shown in FIG. 1 on a pool 10 having side and end walls 12 and 14. The walls form a pool chamber 16 filled with water 18.

A pair of water inlet conduits 20 comprised of a number of segments interconnected by appropriate couplings 19 extend into the pool and in opposite directions along the adjacent pool end walls 14 and thence along the side walls 12 terminating at steps 24 in the opposite end wall 14. Outlet jet openings 26 are provided along the length of the inlet conduits 20 to evenly distribute water into the pool around its perimeter. The size of the outlet openings may be varied to give the desired uniform distribution of water throughout the pool area. The angle of the openings in the inlet conduits 20 may also be selectively varied to direct the stream of water 28 at the desired angle into the pool.

It is seen that a space 30 is provided between the inlet conduit 20 and the pool side walls 14 and 12 through use of eye bolts 32 having a spacer shoulder 34 and a nut 39 on the inside of the walls. It is also seen that concrete 37 may be poured on the bolts on the inside of the walls to permanently maintain them in place and to give further rigidity to the connection of the eye bolts to the walls.

Figure 3:
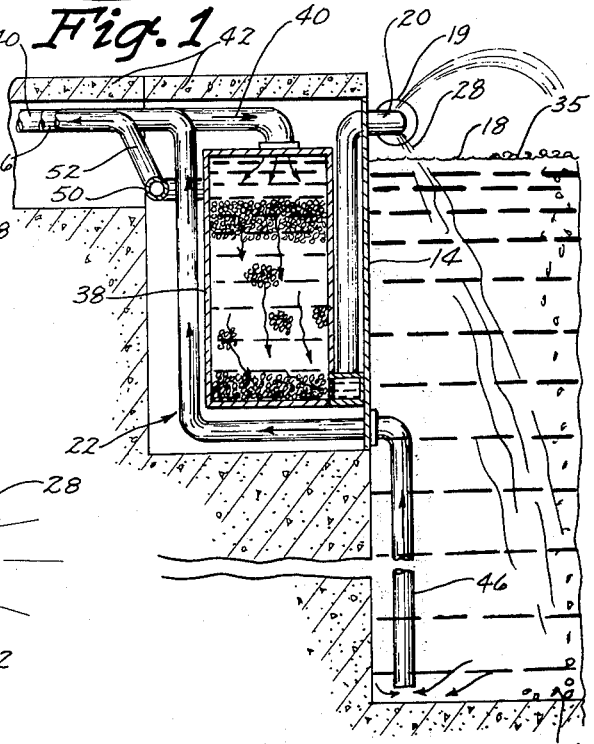
FIG. 3 is a fragmentary cross-sectional view taken along line 3 — 3 in FIG. 2.

Further adjustment of the inlet conduits may be accomplished by simply rotating the conduits in the eye bolts such that the desired jet projectory is provided from a normal daytime position of the water being directed downwardly into the pool as seen by the solid lines in FIG. 3 or upwardly as a fountain as indicated by the dash lines in FIG. 3. When the water is being directed upwardly as a fountain the water is cooled by exposure to the cool night air but also provides a very pleasing appearance which can be considerably enhanced by the addition of colored lights directed on the jets of water projecting upwardly around the periphery of the pool.

The cleaning of the bottom of the pool is further enchanced by the use of lengths of hose 31 connected to spigots 33 appropriately spaced around the length of the inlet pipe 12. The length of hose would have a tail on the bottom of the pool of between 2 and 6 feet in length to agitate the dirt and sediment particularly at nighttime.

The circulation of the water by the plurality of inlet jets 28 spaced six to twelve inches apart as compared to ten feet on conventional pools greatly increases the sanitation of the water by its being changed more frequently. As is also been in FIG. 3 the sediment 35 on the bottom of the pool is caused to rise to be removed by the skimmers.

It is seen that the space 30 is just sufficient to allow only the finger tips of a person to grasp the inlet conduit pipe 20 and thus allow the pipe to be used as a hand rail but not allow the swimmer to extend his hand fully around the pipe. Thus injury to a person's hand is avoided as well as possible damage to the pipe and its securing fastener means while still giving the swimmer safety in having a hand rail all along the pool's perimeter.

The inlet pipes 20 are in communication with a conventional filtering unit 38 positioned in the system chamber 22. The filter 38 is fed by a pipe 40 extending directly under coping 42 to the pump 44 located remotely of the system chamber 22 as required by the most city ordinances.

It is further seen that the water is removed from the pool through an outlet conduit 46 extending directly out of the system chamber 22 and downwardly adjacent the deep end side wall 14 as seen in FIG. 3. It is apparent that the outlet pipe 46 is fully exposed inside the pool 16 and will draw water from the pool just as a drain located in the bottom of the pool with pipes extending under ground to a remotely located pump. As seen in the drawings, the outlet pipe 46 extends through the end wall 14 and through the system chamber 22 thence upwardly and outwardly to the pump 44 adjacent the pipe 40 feeding the filter unit 38.

A series of skimmer units 48 are positioned in the side walls of the pool around the perimeter thereof and are interconnected by a pipe 50 which also extends freely and independently of the pool along and below the coping 36. The pipe forms a T as seen in FIG. 2 with the wing portions 50 extending in opposite directions around the perimeter of the pool and the leg 52 extending to the pump 44.

Figure 2:
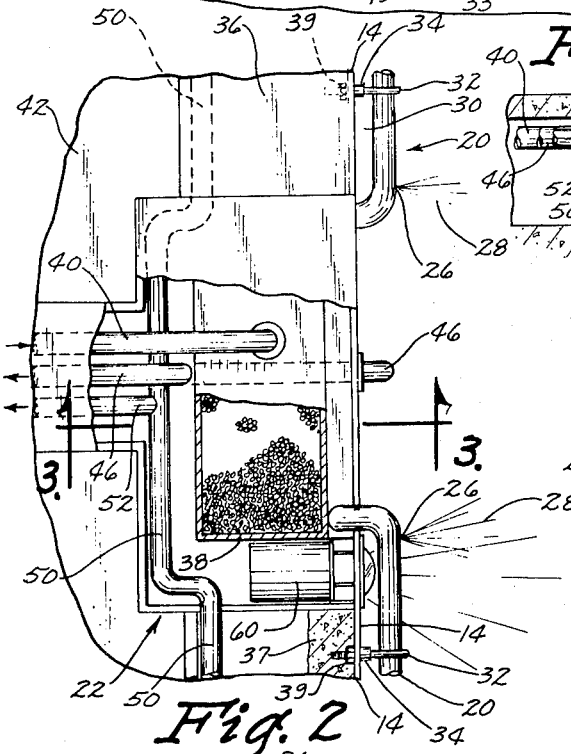
FIG. 2 is a fragmentary top plan view of the system chamber including the filter unit and light unit showing the pipes and conduits all being in communication with this chamber.

In addition to the water circulation system which is easily installed and easily maintained when service work is required the pool is provided with a pool light 60 positioned in the system chamber 22 and mounted in the end wall 14 as seen in FIG. 2 and thus is fully exposed for maintenance work if ever required.

The inlet conduit 20 sections may be made of high strength plastic material which is readily shaped to follow the contour of the pool walls 12 and 14. The outlet set openings 26 are preferably constructed to provide high pressure water streams 28 which will tend to move the surface water and allow it to be skimmed by the skimmers 48 automatically as well as agitate the sediment on the bottom of the pool a seal may be provided on the eye bolts 32 of a Neopreme or like material to provide sealing between the walls 12 and 14 and the eye bolts for the pipe 20.

Figure 4:
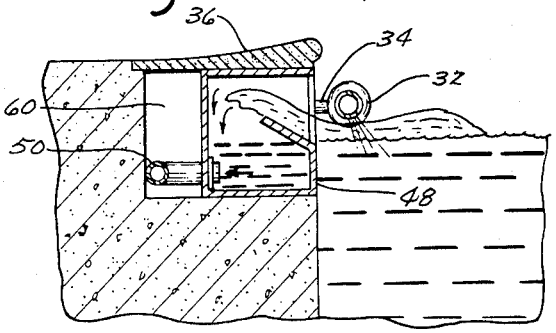
FIG. 4 is a cross-sectional view taken along line 4 — 4 in FIG. 1.

As seen in FIG. 4 the coping 36 extends completely around the pool and over the space 60 provided for the skimmer outlet pipes 50. Thus in operation it is seen that the pump 44 will draw water in from the deep end interiorly located outlet pipe 46 as well as from the skimmers 48 through the skimmer pipes 50 whereupon the water will be pumped back through the pipe 40 to the filter 38 and the water under pressure will enter the inlet pipes 20 to be uniformly distributed around the pool as seen in FIG. 1. The deep end outlet pipe 46 as seen in FIG. 3 will draw the water from the bottom of the pool and tend to help clean the bottom of the pool since the lower end of the pipe is closely positioned to the bottom surface. At the same time the inlet streams 28 from the inlet pipes 20 will agitate the surface water to cause it to skim the debris thereon into the shimmers 48 as seen in FIG. 4 whereupon the water will be drawn away through the skimmer outlet pipe 50.

Again it is stressed that the water circulation system may be easily installed in building a pool and may be prefabricated in its entirety. Equally as important is that all of the water circulation conduits and pipes are readily accessible to be inspected for leaks or the like. The safety of the pool is substantially increased through the use of the circulation system of this invention due to its providing a finger-type rail around the periphery of the pool at the approximate water level of the pool and thus the swimmer has something to grab hold of close at hand at all times but yet the finger hold pipe will not cause injury to the swimmer's hand since it is carefully spaced a predetermined distance from the pool side walls to prevent the hands of the swimmers from being caught.

Figure 5:
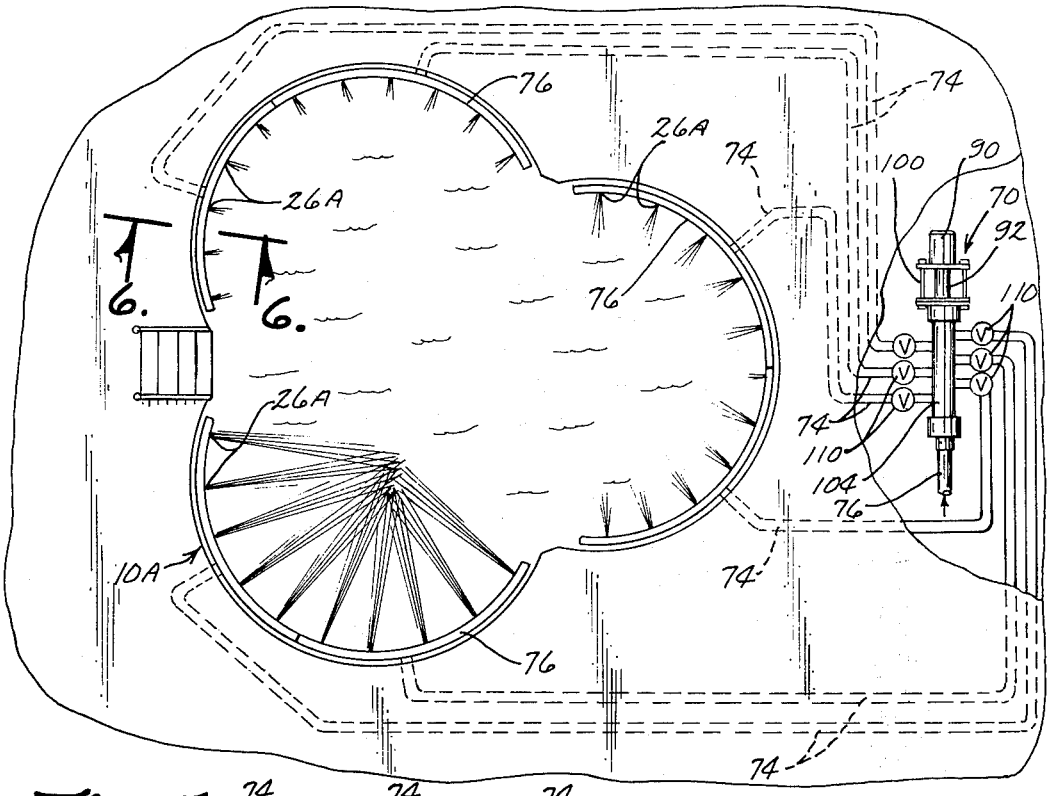
FIG. 5 is a top plan view of a swimming pool including six inlet conduit sections connected to a variable pattern control flow valve for producing a variety of fountains around the periphery of the pool.
Figure 7:
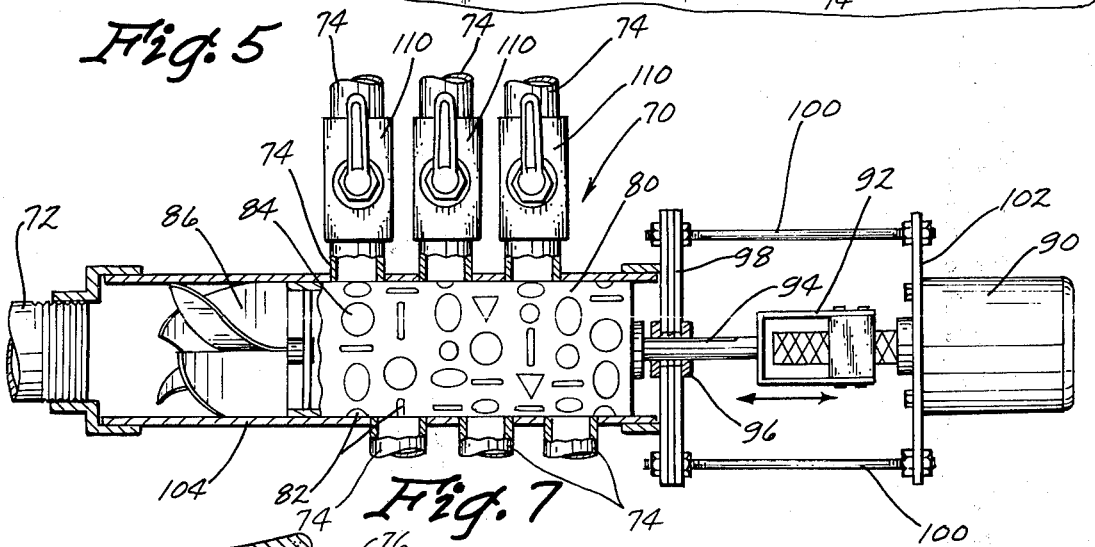
FIG. 7 is a fragmentary cross-sectional view of the control valve.
Figure 6:
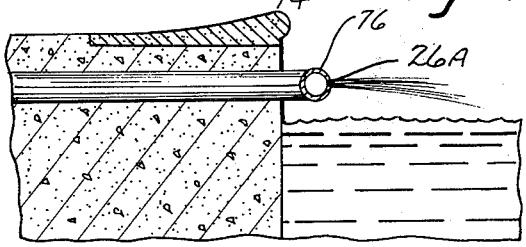
FIG. 6 is a cross-sectional view taken along line 6 — 6 in FIG. 5.

In FIGS. 5–7 a variable pattern control flow valve 70 is positioned in the water source line 72 and includes six inlet conduit sections 74 connected to inlet conduit sections 76 on the walls of a cloverleaf-shaped pool 10A. The inlet conduit section 76 serve one-half of a pool wall defining each leaf. A plurality of spaced apart openings 26A are provided in the inlet conduit sections 76 from which jet streams of water flow to provide fountains of different patterns around the periphery of the pool as seen in FIG. 5.

The control valve 70 includes a cylindrical valve element 80 having longitudinally spaced apart peripherally arranged rows of openings 82 of different areas and configurations. The openings 84 are positioned to register with the inlet conduit sections 74. The cylindrical valve element 80 is hollow on its interior and on the side towards the water source includes a vaned prop 86 which upon reacting with the inlet water pressure continuously turns the valve element 80 thereby continuously varying the fountains of water for each of the inlet conduit sections 76.

Also shown in FIG. 7 is a motor 90 connected through a reciprocal drive unit 92 to the valve element 80 by a shaft 94. Shaft 94 extends through a bearing 96 in a valve end wall 98. The unit 92 provides longitudinal reciprocal movement of the shaft 94 in turn moving the valve element 80 such that the rows of openings 82 alternately register with different inlet conduit sections 74 to further provide varying fountain patterns within the pool 10A. The motor 90 is supported by a plurality of bolts 100 connecting a motor base 102 to the end wall 98 of the valve 70. The housing or sleeve 104 to which the inlet conduit section 74 is connected may be as long and as large in diameter as necessary to accommodate the enclosed cylindrical valve element 80. It is further understood that the speed of rotation can be varied accordingly. The size of the cross sectional shape of the inlet conduit section 74 will be coordinated with the size and shape of the openings 84 to give the desired fountain affect. Furthermore, the length of the openings 84 along the periphery of the valve element 80 will determine the duration of the fountain pattern from each inlet conduit section 76 while the width will affect the quantity of water flowing with a long and wide opening supplying a large amount of water over a long period of time at the inlet conduit section 72 openings 26A. It is understood that with an appropriate selection of lighting in combination with the continuously varying fountain patterns around the periphery of a pool, a panoramic display of colored water activity will result.

Each of the inlet conduit sections 74 include their own valves 110 for individually controlling water to the pool 10A.

It is further seen that a longitudinal row of openings in FIG. 7 provides a different opening for each inlet conduit section 74 thereby providing a different fountain activity along each inlet conduit section 76 in the pool whether or not the valve element 80 is rotating or not. This pattern of activity will be static by comparison to the fountain activity presented when the valve element 80 is being rotated by either the vaned prop 86 or the motor 90. Additional interest may be generated by use of a reciprocating coupling unit 92 which will vary further the fountain pattern for each of the inlet conduit sections 76.

I claim:

1. A control flow valve assembly comprising, a housing having an inlet opening and a plurality of outlet openings, a hollow cylindrical valve element in said housing and said inlet opening being in communication with the interior of said hollow cylindrical valve element, said valve element being completely open along its entire axial length, means for continuously rotating said valve element, a plurality axially spaced apart rows of peripheral openings in said valve element and a row of openings being successively registrable with each of said outlet openings, reciprocal power means being provided for moving said valve element longitudinally such that each outlet opening is alternately aligned with different rows of openings, said openings in adjacent rows being successively different in shape and size to provide different flow patterns, and said means for continuously rotating said valve element comprising a vane means being provided at the inlet end of said valve element and connected directly thereto to react with an inlet pressure source to turn said valve element and vane as a unit about a common longitudinal axis.

* * * * *